US005482279A

United States Patent [19]

Antonious

[11] Patent Number: 5,482,279

[45] Date of Patent: Jan. 9, 1996

[54] GOLF CLUB METAL WOOD-TYPE HEAD WITH IMPROVED PERIMETER STRUCTURE AND WEIGHT CONFIGURATION

[76] Inventor: Anthony J. Antonious, 7738 Calle Facil, Sarasota, Fla. 34238

[21] Appl. No.: 280,177

[22] Filed: Jul. 25, 1994

[51] Int. Cl.[6] ..... A63B 53/04

[52] U.S. Cl. ..... 273/167 H; 273/167 J

[58] Field of Search ..... 273/167 H, 167 J, 273/167 K, 169, 173, 78, 171, 172, 174, 167 A, 167 G

[56] References Cited

U.S. PATENT DOCUMENTS

| | | | |
|---|---|---|---|
| 4,214,754 | 7/1980 | Zebelean | 273/171 |
| 4,511,145 | 4/1985 | Schmidt | 273/169 |
| 5,000,454 | 3/1991 | Soda | 273/173 |
| 5,106,094 | 4/1992 | Desbiolles et al. | 273/167 H |
| 5,141,230 | 8/1992 | Antonious | 273/169 |
| 5,163,682 | 11/1992 | Schmidt et al. | 273/167 J |
| 5,183,255 | 2/1993 | Antonious | 273/167 J |
| 5,213,328 | 5/1993 | Long et al. | 273/173 |
| 5,271,621 | 12/1993 | Lo | 273/173 |
| 5,295,689 | 3/1994 | Lundberg | 273/173 |
| 5,362,055 | 11/1994 | Rennie | 273/167 H |

*Primary Examiner*—Vincent Millin
*Assistant Examiner*—Steven B. Wong
*Attorney, Agent, or Firm*—Finnegan, Henderson, Farabow, Garrett & Dunner

[57] ABSTRACT

A metal wood-type golf club head has an improved perimeter weighting structure and weight configuration through the inclusion of a peripheral mass positioned along at least the majority of the ball striking face and the crown of the clubhead and extending downwardly along at least the upper portion of the interface between the ball striking face and side walls thereby providing added strength and stability to the club head and minimizing pinging of the club head when the ball contact is made. The club head has a hosel intergrally connected to the club head body, and the hosel is preferably connected to the peripheral mass.

59 Claims, 7 Drawing Sheets

PRIOR ART

GOLF CLUB METAL WOOD-TYPE HEAD WITH IMPROVED PERIMETER STRUCTURE AND WEIGHT CONFIGURATION

BACKGROUND OF THE INVENTION

The present invention relates to golf clubs, and in particular, to an improved metal wood-type golf club having improved perimeter structure and weight distribution.

Many wood-type golf club heads are now made of metal. The conventional metal wood-type clubs are formed with a relatively thin face and a thin metal shell, which typically surrounds a foam filled cavity. The clubfaces of conventional metal wood clubheads join or interface with the upper crown portion, side walls, and the sole plate of the clubhead. Generally, there is no significant additional mass provided where the clubface connects with these other parts of the clubhead. Some of these club heads have reinforced ball striking faces to add strength and stability at the point where a golf ball is struck.

A recent tendency has been to make these types of club heads larger, making them more attractive to the golfer and also easier to hit. Such metal woods, because of their larger sizes, generally have thinner club faces and even thinner upper crowns and surrounding walls.

This design structure has created many problems in the industry because such metal wood club head structures may incur cave-ins at the clubface, stress cracks in the surrounding walls, and buckling at the upper crown portions of the club head when golf balls are struck repeatedly with great force. Moreover, these types of metal woods often must be filled with foam, because of the otherwise high noise level in the form of a pinging or tinning sound, generated when ball contact is made. Foaming adds to the cost of production and leads to other problems, such as the selection of the right kind and amount of foam to completely fill the shells, so that foam serves it purpose and does not come loose after the club has been used.

Various attempts have been made to reinforce metal wood-type golf club heads as evidenced by the U.S. Patent to Raymont (U.S. Pat. No. 3,847,399) which reinforces the rear inner surface of the ball striking face with a honeycomb structure and my own U.S. Pat. No. 5,141,230, which reinforces the interior of a metal wood with a first mass located behind the ball striking face and a second mass under the upper or crown surface of the club head. These and other attempts at strengthening and modifying the structural integrity of conventional metal woods have experienced varying degrees of success.

SUMMARY OF THE INVENTION

Among the objects of the present invention is the provision of a metal wood-type golf club head that provides improved performance.

Another object of the present invention is the provision of a metal wood having improved perimeter structure and weight configuration for added strength and stability at impact.

These and other additional objects and advantages of the invention will become apparent with reference to the description which follows and, in part, will be obvious from the description or may be learned from the practice of the invention. The objects and advantages of the invention will be realized and attained by means of the elements and combinations pointed out in the appended claims.

To achieve the objects and in accordance with the purpose of the invention, as embodied and broadly described herein, the invention comprises a metal wood-type golf club head comprising a golf club head body including a heel, toe, bottom, crown, ball striking face and a rear club face, the ball striking face intersecting with a forwardmost progression of the bottom to define a leading edge of the ball striking face; a hosel integrally connected to the club head body; and a peripheral mass positioned along at least the majority of the interface of the striking face and the crown of the club head. The peripheral mass preferably extends downward into the upper portions of the respective interfaces between the striking face and the side walls adjacent the heel and toe and, most preferably, extends around all or substantially all of the interfaces between the striking face and the crown, side walls, and bottom of the club head.

To achieve the objects and in accordance with the purpose of the invention, as embodied and broadly described herein, the invention also comprises a metal wood-type golf club head with a golf club head body including a heel, toe, bottom, top ridge, crown, ball striking face, and a rear club face. The ball striking face intersects with a forwardmost progression of the bottom to define a leading edge of the club face, and the club head body has a frontal body section and a rearward shell attached to the frontal body section at the interface of the frontal body section and the rear shell. The club head also has a hosel integrally connected to the club head body. The frontal body section of the club head includes the ball striking face, a rear club face spaced rearwardly from and opposite the ball striking face, and a peripheral mass that projects outwardly from the rear club face. The peripheral mass extends around at least a portion of the outer periphery of the frontal body section. The shell of the club head extends rearwardly beyond the frontal body section and forms the crown portion of the club head, the rear section of the club head, and a cavity behind the rear club face of the club head. In certain embodiments, an opening is formed in the shell, to provide a pressure relief at the point of impact. This design promotes optimum flexing of the ball striking face when the ball is hit.

The present invention is uniquely applicable to metal wood-type golf club head designs. The peripheral mass, which also serves as reinforcement member, extends at least along the majority of the top of the frontal body section and preferably extends around the entire periphery of the frontal body section where the outer walls of the shell and the frontal body section interface. Another feature of the preferred embodiment is an integral connection between the hosel and the frontal body section, in a shankless configuration. The hosel preferably extends into and is connected with the peripheral mass adjacent the heel of the club head.

This unique metal wood configuration, particularly the use of the peripheral weighting and reinforcement system, acts as a buffer to prevent buckling and minimize excessive shock and vibration which occurs when a golf ball is struck. The invention eliminates disastrous buckling of the club face and/or the walls of the upper crown and sides of the club head. Furthermore, by overcoming the flexing of the upper crown from the knock-back effect at impact, the noise level is greatly reduced over that of the conventional metal wood-type club heads. Consequently, foaming is often not required to suppress undesired noise levels, and additional bracing is generally not required to provide additional inner support to the shell walls.

The metal wood-type golf club head of the present invention also provides greater stability at impact and provides increased club head resistance to twisting and torquing, especially when hitting golf balls from thick or heavy grass conditions, or when off-center ball contacts are made. The present invention also provides a more even distribution of mass to produce more solid ball contact, for greater distances and improved accuracy.

It is to be understood that both the foregoing general description and the following detailed description are exemplary and explanatory only and are not restrictive of the invention, as claimed.

The accompanying drawings, which are incorporated in and constitute a part of the specification, illustrate several embodiments of the invention and, together with the description, serve to explain the principles of the invention.

DESCRIPTION OF THE PREFERRED EMBODIMENTS

Figure 1:
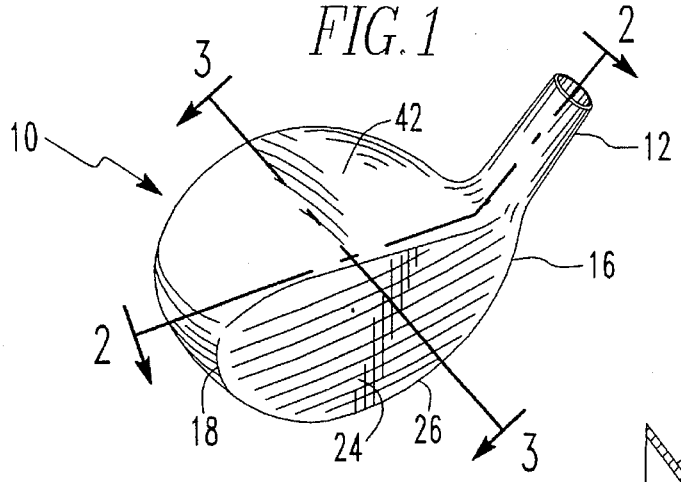
FIG. 1 is a front perspective view of a first embodiment of a metal wood-type golf club head of the present invention.

Reference will now be made in detail to the present preferred embodiments of the invention, examples of which are illustrated in the accompanying drawings. Wherever possible, the same reference numerals or like numerals will be used throughout the drawings to refer to the same or like parts.

Figure 38:
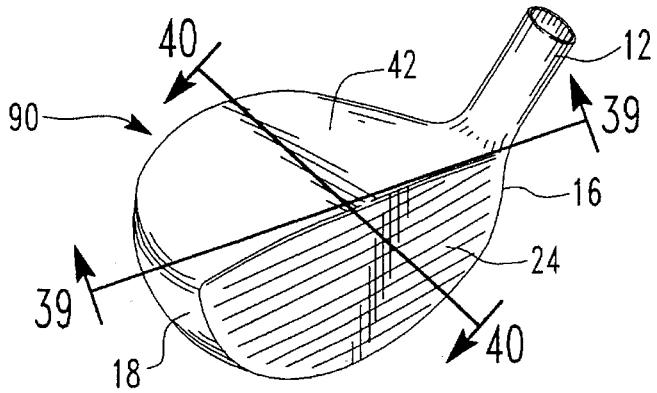
FIG. 38 is a front perspective view of a conventional metal wood-type golf club head.

Before the present invention and its preferred embodiments are described in detail, a reference will first be made to a conventional metal wood-type golf club head, like that illustrated in FIGS. 38–40. Such a conventional club head, depicted generally as 90 includes a hosel 12, a heel 16, a toe 18, a bottom 22, and a ball striking face 24. The club head further includes a top or crown surface 42, a rear shell surface 44, and side walls 45 and 46 at the toe and heel of the club head, respectively. The crown, bottom, rear surface, and side wall form a shell positioned behind the ball striking face 24 of the club head.

Figure 39:
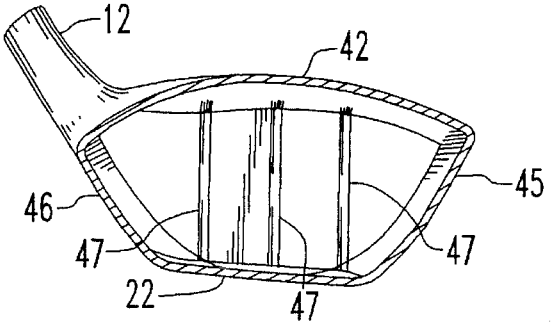
PRIOR ART FIG. 39
FIG. 39 is a sectional view of the conventional metal wood-type club head of FIG. 30, taken along lines 2—2 of FIG. 38.
Figure 40:
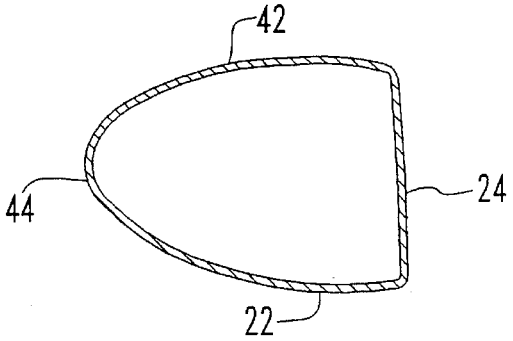
PRIOR ART FIG. 40
FIG. 40 is a cross sectional view of the conventional metal wood-type club head of FIG. 38, taken along lines 3—3 of FIG. 38.

As shown in FIG. 39, the side walls, crown, and bottom of the golf club head connect directly to the ball striking face. The hosel 12, in turn, is connected with the crown 42, side wall 46, and ball striking face 24 proximate the heel 16. The hosel does not extend into the rear shell of the clubhead. The club head illustrated in FIGS. 38–40 also includes ribs 47 to reinforce the striking face. Normally the sides, crown, rear, and ball striking face of conventional metal-wood clubs are molded in a single operation, and the sole plate or bottom is subsequently welded to this molded structure. As best shown by FIGS. 39 and 40, the club head has a relatively thin club face 24 and thin metal crown 42, and no reinforcement or added mass is included at the interface of the ball striking face with the side walls, bottom, and crown.

The present invention represents an improvement over such conventional metal wood-type club heads and relates to a metal wood-type golf club head having a unique configuration, weight distribution, and structure. The invention includes an inner peripheral weighting and reinforcement system formed along all or a portion of the interface between the ball striking face and the crown, side walls, and bottom of the club head. The invention also includes a shankless hosel construction in which the entire hosel is spaced from and behind the ball striking face. Preferably, the hosel of the club head is connected to not only the outer surfaces of the club head adjacent the heel but also to the peripheral weighting and reinforcement system.

The peripheral weighting and reinforcement system takes the form of an additional mass of metal positioned at least along the majority of the interface of the ball striking face and crown of the club head, and preferably along the interface of the ball striking face and the side walls, as well as the bottom. This additional mass is thicker than the respective walls of the ball striking face and crown, side walls and bottom of the club head proximate this added mass and adds strength and stability to the resultant club head.

The present invention, several embodiments of which are disclosed below, should in most, if not all, instances permit the golf club head to be made and used without foaming the internal cavity, since the noise and detrimental vibration forces are significantly minimized, if not, eliminated, by the invention. The club head structure further provides a metal wood-type golf club head which eliminates the possibility of the ball striking face caving in, cracking, or creating other distortions of the crown, bottom, or side walls of the club head due to the forces which occur when a golf ball is struck during the execution of a golf stroke.

Several embodiments of the present invention are illustrated in the Figures and are described below.

Figure 2:
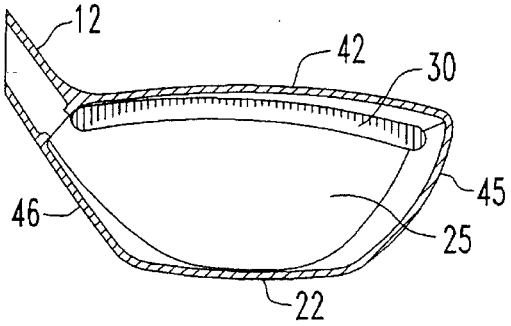
FIG. 2 is a sectional view of the golf club head of FIG. 4, taken along section lines 2—2 of FIG. 1.
Figure 3:
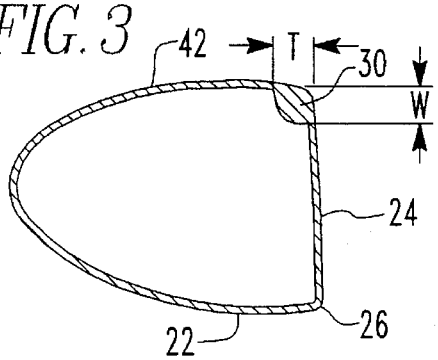
FIG. 3 is a cross-sectional view of the golf club head of FIG. 4, taken along lines 3—3 of FIG. 1.
Figure 4:
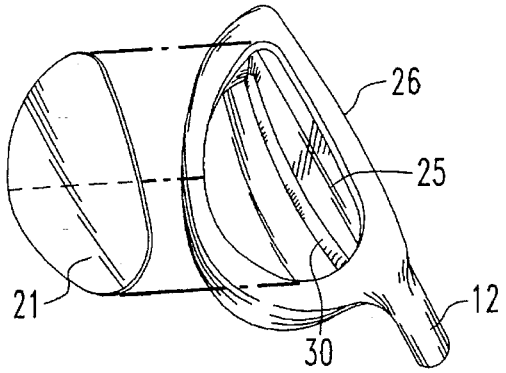
FIG. 4 is a bottom, exploded view of the club head of FIG. 1.

Referring to the drawings, FIGS. 1 to 4 show a first embodiment of metal wood-type golf club head 10 in accordance with the present invention. The club head body 10 includes a hosel 12, heel 16, toe 18, bottom 22, a ball striking face 24 forming the frontmost portion of the club head, and a rear club face 25. The forwardmost progression of the bottom 22 and a ball striking face 24 forms a leading edge 26 of the ball striking face 24. The club head further includes a crown 42, a rear shell surface 44, and side walls 45 and 46 at the toe and heel of the club head, respectively. The bottom 22 of the club head in this embodiment includes a sole plate 21, as shown in FIG. 4.

As shown in FIGS. 2–4, the club head includes a peripheral mass 30 which extends along the interface between the ball striking face and crown of the club head. This peripheral mass provides increased weight distribution at the upper portion of the club head and more importantly provides added strength and stability to the club head while also greatly minimizing or eliminating the pinging of the club head when ball contact is made. In most if not all circumstances, the addition of this mass will completely eliminate buckling of the club head, particularly its crown, as well as eliminate the need for foaming of the metal wood-type club head made according to the present invention. In this embodiment the hosel 12 is connected to the crown 42, side walls 46, and ball striking face 24 proximate the heel 16.

As shown in FIG. 3 the peripheral mass 30 is thicker, in both front to rear direction ("T" shown in FIG. 3) and top to bottom direction ("W" shown in FIG. 3), than the respective walls of the ball striking face 24, the crown 42, and the side walls 45 and 46 immediately adjacent the peripheral mass. Preferably, the front to rear thickness ("T") peripheral mass 30 is at least 0.125 inches, but no more than 0.250 inches. Preferably, the top to bottom thickness or width "W" of the peripheral 34 mass is at least 0.125 inches but no longer than 0.250 inches. The ball striking face should preferably be at least 0.100 of an inch, and the thickness of the crown and side walls should preferably be from 0.020 to 0.050 of an inch. Although the peripheral mass in the embodiment shown in FIGS. 1–4 is continuous, it is possible to use a segmented peripheral mass, as will be described in more detail below.

In this first embodiment, the club head can be made by any one of a number of operations. However, it is presently contemplated that this embodiment can be made by the standard technique of molding the striking face and rear shell as one component and the sole plate of the club head as a second component and then welding the sole plate to the molded first component of the clubhead, in a subsequent operation. That aspect of this embodiment is illustrated generally by FIG. 7 and is a manufacturing technique well known in the art. As explained below, it is contemplated that the present invention can also be made by alternate techniques.

Figure 5:
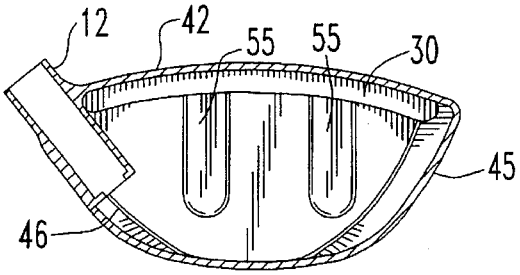
FIG. 5 is a rear, section view of a second embodiment of the present invention.

In the embodiment shown in FIG. 5, the peripheral mass 30 is similar in position, shape and relative size to that shown in FIGS. 1–4. That is, the peripheral mass 30 extends continuously along the entire interface between the ball striking face and the crown of the club head. In this embodiment, however, the hosel 12 extends approximately halfway into the shell of the club head and is attached to at least the side wall adjacent the heel portion, and preferably also to the rear club face adjacent the heel portion. The hosel preferably extends into the shell by at least 0.500 inches. This design permits the use of a shorter exterior hosel and provides more rigidity and strength at the connection between the shaft and club head. It also permits the distribution of weight closer to the center of gravity of the club head. As a result, torquing and twisting is minimized, and strength and maximum energy transfer is maximized.

The embodiment shown in FIG. 5 also includes two vertical wide bars 55 that project outwardly from the rear club face and extend into the peripheral mass 30. These vertical bars preferably are positioned on opposite sides of the club head's center of gravity and do not extend to the bottom of the club head. These bars provide reinforcement to the ball striking face and crown, permit controlled flexing of the ball striking face, and provide optimum weight distribution. The resultant combination of the upper peripheral mass 30 and the bars 55 provide increased mass and controlled flex at the top portion of the club head, which produces lower ball flight and greater roll and distance. Although this aspect is illustrated only in FIG. 5, it can be included in other embodiments of the invention, such as those described below.

Figure 6:
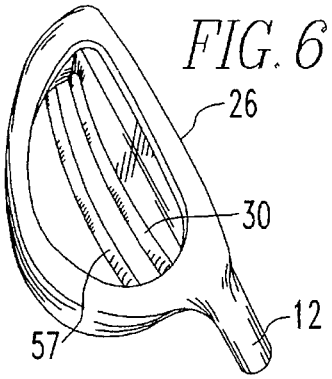
FIG. 6 is a partial, bottom perspective view of a third embodiment of the present invention.

In the embodiment shown in FIG. 6, the club head includes a peripheral mass 30, like that shown in FIGS. 1–4, and in addition includes a wide strut 57 that projects from the underside of the crown and extends from the heel to the toe of the club head. This strut 57 further strengthens the club head, to further minimize and prevents buckling of the crown. It also, in combination with the upper peripheral mass 30, adds weight to the top portion of the club head. This strut preferably should be positioned approximately 0.750 to 1 inch behind the intersection of the ball striking face 24 and the crown 42.

Figure 7:
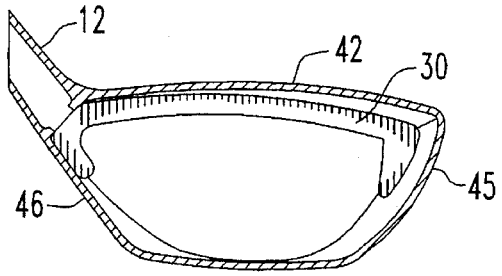
FIG. 7 is a rear, section view of a fourth embodiment of the invention.

FIG. 7 illustrates an embodiment like that shown in FIGS. 1–4, with the exception that the peripheral mass 30 extends downwardly along a portion of the respective interfaces between the ball striking face and the side walls of the club head adjacent the heel and toe of the club head. In addition, the hosel 12 is attached at least in part with the peripheral mass adjacent the heel. As a result, this design provides a stronger connection between the shaft and the club head and the striking face and the remaining portion of the club head.

Figure 8:
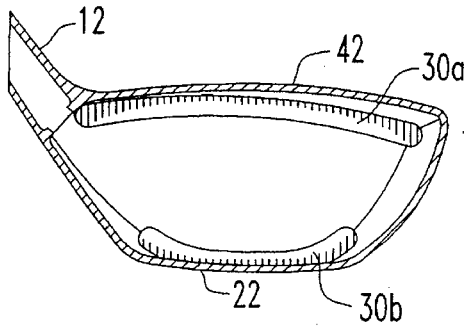
FIG. 8 is a rear, section view of a fifth embodiment of the present invention.
Figure 9:
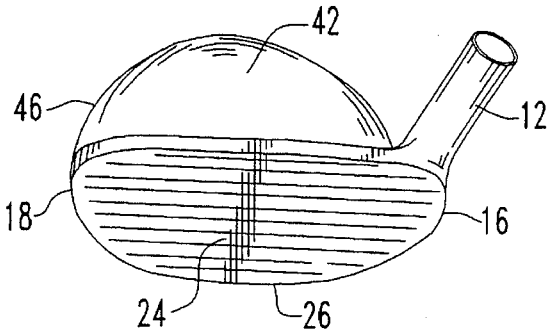
FIG. 9 is a front perspective view of a sixth embodiment of a metal wood-type golf club head of the present invention.

In the embodiment shown in FIG. 8, the peripheral mass 30 includes an upper portion 30*a* and a lower portion 30*b*. This design provides a more equal distribution of mass about the club head's center of gravity, while providing increased strength of the entire club head. The inclusion of the lower peripheral mass 30*b* will provide a higher trajectory of the ball being hit and is especially preferred for use in the design of fairway woods. Again, this design can be incorporated in many of the embodiments disclosed herein.

In the embodiment shown in FIGS. 9–13, the golf club head includes a frontal body section 60 and a rearward shell 70 attached to the frontal body section 60 at the interface of the rear edge of the frontal body section 60 and the forward edge of the rear shell 70. The frontal body section 60 includes the ball striking face 24, a rear club face 25 spaced rearwardly from and opposite the ball striking face, and a peripheral mass 30 projecting outwardly from the rear club face 25 and extending around the entire periphery of the frontal body section 60. The peripheral mass includes an upper portion 30*a*, a lower portion 30*b*, a heel portion 30*c*, and a toe portion 30*d*.

The rearward shell 70 includes a bottom surface 22 which extends beyond the rear surface 62 of the frontal body section 60, specifically the rearmost portion of the peripheral weight 60. The top outer portion of the shell 70 forms a crown 42, an outer rear surface 44, and side walls 45 and 46 of the golf club head 10.

Figure 10:
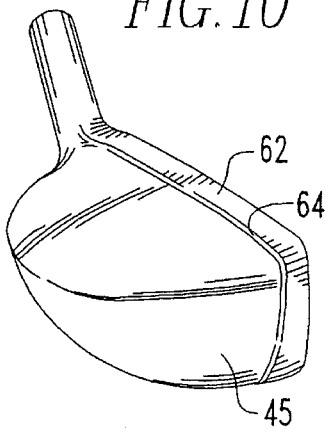
FIG. 10 is a rear perspective view of the golf club head of FIG. 9.
Figure 11:
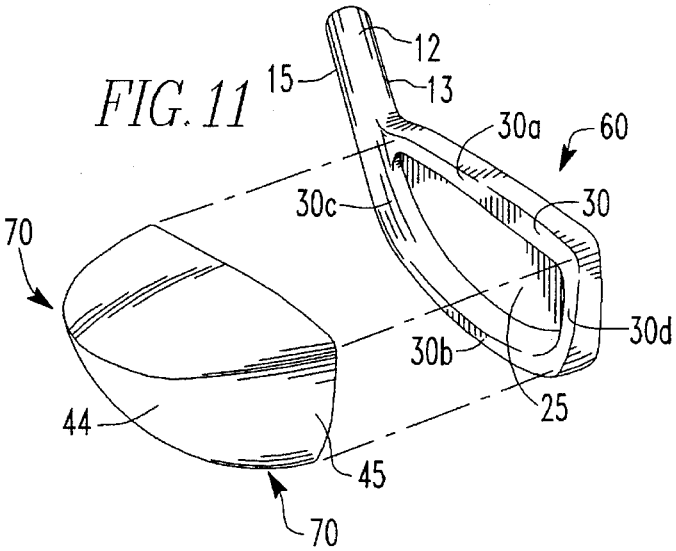
FIG. 11 is an exploded view of the club head of FIG. 9.

In the embodiment shown in FIGS. 9–13, a peripheral mass 30 extends around the entire periphery of the frontal body section 60. The peripheral weight 30 is formed proximate the interface formed by juncture of the shell 70 and the frontal body section 60, as best seen in FIG. 11. The relative thicknesses and widths of the peripheral mass 30 to the thicknesses of the ball striking face, crown, and side walls of the club head are of the same order as previously disclosed.

In the embodiment shown in FIGS. 9–13, the club head has a flat striking face 24, and the entire portion of the hosel 12 is positioned behind the plane defined by the ball striking face 24 of club head 10. As shown in FIG. 11, the hosel 12 transitions smoothly into the peripheral mass 30 both at the side 30*c* and lower portion 30*b* of the peripheral mass, thereby providing increased strength and stability to the clubhead. The hosel also connects with the top 30(*a*) of the peripheral mass 30. The hosel 12 has an upper front surface 13 and a rear surface 15. The rear surface preferably smoothly transitions into the rear surface of the peripheral mass 30 adjacent the heel 46 of the clubhead. This design provides additional structural integrity and strength at the heel portion of the club head. The front surface 13 is preferably positioned behind the entire ball striking face 24 of the clubhead 10, forming a shankless connection between the hosel 12 and the club head 10. In such an embodiment, the leading edge of the ball striking face 24 is progressed forwardly of the hosel 12 as disclosed in U.S. Pat. No. 5,183,255 which patent is incorporated herein by reference. It will thus be appreciated that in the preferred embodiment the hosel and frontal body section connection are integrally formed into a solid one-piece structure.

As shown in FIG. 10 and 11, the rear shell 70 interconnects with the frontal body section 60 at an interface. In this embodiment, the interface is the rear surface 32 of the peripheral mass 30, and the shell 70 is connected to the frontal body section 60 by conventional means, such as welding, after the shell and frontal body section are independently molded. By using this procedure, the frontal body section can be made from one material, such as steel, and the rear shell 70 can be made of another, preferably lighter and stronger material, such as titanium. This permits the optimum distribution of mass close to the striking surface of the club head. It is also possible that the frontal body section 60 and the shell 70, except one surface such as the bottom, can be molded as a unitary structure with the remaining surface made by a separate process and then welded to the unitary structure. Then, the bottom or sole plate, can be welded to this unitary structure.

In the embodiment shown in FIGS. 9–13, a ledge 64 is formed along the crown 42 and sides of the shell 70 proximate the toe 18 and heel 16. This design evenly distributes the weight of the shell so that it is closer to the club head's center of gravity and concentrates more weight available at impact behind the ball. This design also provides a top ridge 62 and a clear sighting line from ledge 64 to promote proper setup and thus better club control.

Figure 12:
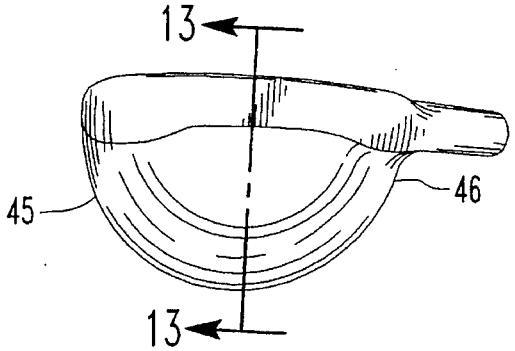
FIG. 12 is a bottom view of the club head of FIG. 9.
Figure 13:
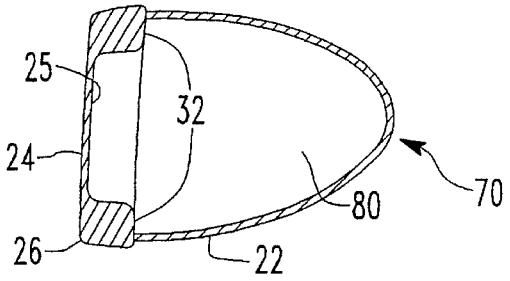
FIG. 13 is a sectional view of the club head of FIG. 9 taken along the line 13—13 of FIG. 12.

As shown in FIG. 12, in this embodiment, the peripheral mass of the frontal body section is thicker at the heel and toe portions than at the center, thereby providing more weight distribution at the heel and toe sections. Thus, peripheral mass of the present invention can be readily shaped and configured to provide optimum weight distribution for different goals.

In the above embodiments, as well as the additional embodiments disclosed below, the total weight of the metal wood-type club head preferably is about 200 grams for a driver, 208–212 grams for a number 3 wood, 218–222 grams for a number 5 wood, 225–230 grams for a number 7 wood, and 231–235 grams for a number 9 wood.

Although the shells shown in the above embodiments are closed shells which create a closed cavity 80 behind the rear club face 25, the shell can be designed in a variety of configurations to provide optimum weight distribution and structural integrity of the complete clubhead. For example, openings can be formed in the shell, preferably at the rear or the bottom of the shell, to thereby permit the additional distribution of weight at locations that best promote distance, control, and structural integrity. An opening in the shell also will promote the most beneficial trampoline effect of the ball striking face, since the opening provides a pressure release that will allow the club face to fully flex at impact. The placement and design of the openings can also provide better acoustics and minimize or prevent pinging. Clubheads with shells having openings in the rear and the bottom are illustrated and will be discussed below.

In addition, one or more aerodynamic channels can be formed on the top of the shell of the club head of the present invention, and a runner or runners can be formed in the bottom of the shell. Examples of such embodiments are discussed below.

As will be explained and illustrated in more detail below, the shape of the peripheral mass can also be varied to achieve the optimum weight distribution and preferred structure for a given total clubhead design and goal. These different shapes can be applied, regardless of whether the clubhead is formed along the lines illustrated in the figures or by other methods of manufacture. For example, the peripheral mass can have a uniform thickness and width and cross-sectional configuration along its entire length. On the other hand, the peripheral mass can be designed to provide more weight at certain areas of the club head, such as the top, bottom, heel, or toe portions, to promote the desired trajectory and ball control.

For example, the central area of the bottom or top portion of the peripheral mass can be less thick or wide than the areas proximate the heel and toe of the clubhead, to compensate for hits made in the heel or toe area of the club. On the other hand, the peripheral mass can be designed and shaped to have more weight at the bottom than the top or more weight at the top than at the bottom. The peripheral mass can also be segmented, as long as the desired strength is not sacrificed. It is presently believed that the peripheral mass should extend along at least the majority of the interface between the crown and ball striking face of the club head, because this is where buckling, particularly of the crown, most often occurs. While a segmented peripheral mass can be used along this interface, the segments preferably should be spaced no more than 0.250 inches from each other. Additional weights member can also be incorporated into the peripheral mass. Whereas the peripheral mass 30 shown in FIGS. 9–13 extends completely around the entire inner periphery of the frontal body section 60 of the club head, the invention is equally applicable to an inner member which extends only part way around the entire periphery.

The resulting golf club head of the present invention provides stability and enhanced performance due to the peripheral weight and reinforcement member 30. As indicated above, not only is the entire golf club head more stable, but the vibration and stress forces generated by striking a golf ball with a club head are greatly reduced thereby eliminating the unpleasant sounds normally produced by metal wood golf clubs, which in turn, eliminates the need for internal foaming of the club head. Having described the general aspects of the invention, some additional embodiments of the invention will be disclosed, as examples of the scope of the invention.

Figure 14:
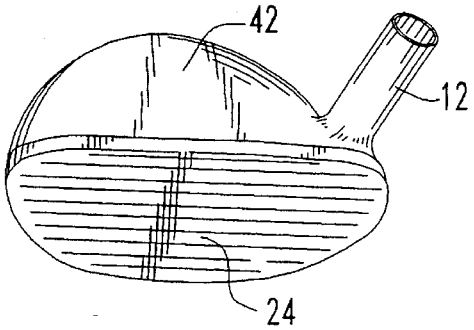
FIG. 14 is a front perspective view of a seventh embodiment of a metal wood-type golf club head of the present invention.
Figure 15:
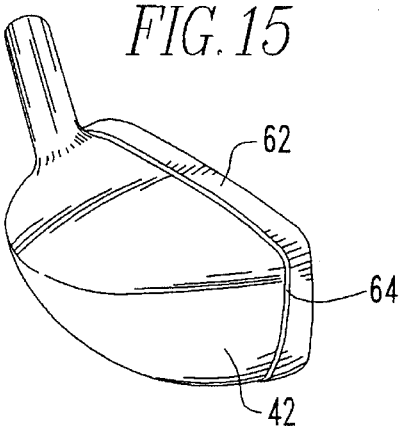
FIG. 15 is a rear perspective view of the golf club head of FIG. 14.

FIGS. 14–15 show an embodiment of the present invention which is similar to those previously shown, with the exception that the hosel 12 is positioned such that its forward edge is placed well behind the ball striking face of the club head. In this embodiment, the hosel can be connected in a standard fashion, such as shown in FIG. 2, to the shell club head. Preferably, the hosel transitions into its peripheral mass, along the lines shown generally in FIGS. 5, 6 and 7. The extension of the hosel into the peripheral mass of the club head provides added strength and stability and also permits the use of a thinner crown or rear shell, thereby allowing the distribution of mass and weight at locations that optimize distance and control.

Figure 16:
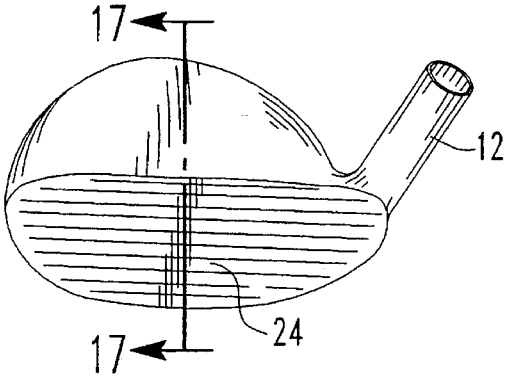
FIG. 16 is a front perspective view of an eight embodiment of the golf club head of the present invention.
Figure 17:
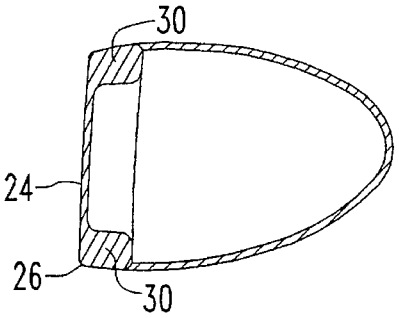
FIG. 17 is a sectional view of the golf club head of FIG. 16, taken along line 17—17 of FIG. 16.

FIGS. 16–17 show another embodiment of the present invention which is analogous to that shown in FIGS. 9–13, with the exception that the frontal body section and the rear shell interface in a manner to provide a smooth transition along the club heads' upper surface or crown, like conventional clubs.

Figure 18:
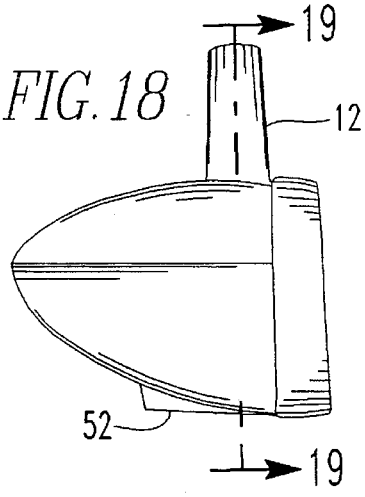
FIG. 18 is a side view of a ninth embodiment of the golf club head of the present invention.
Figure 19:
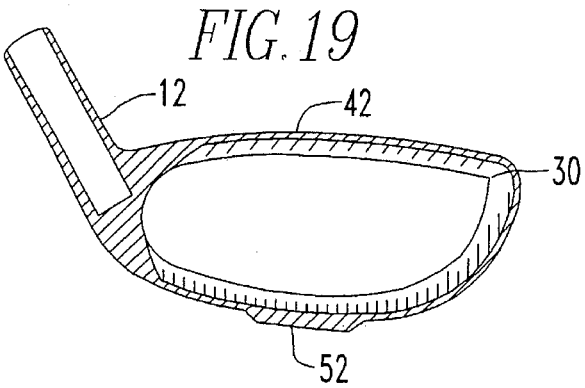
FIG. 19 is a section view of the club head of FIG. 18, taken along line 19—19 of FIG. 18.
Figure 20:
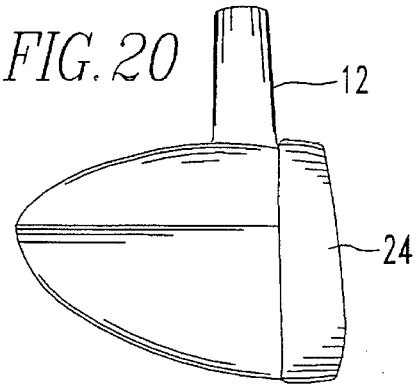
FIG. 20 is a side view of a tenth embodiment of a golf club head of the present invention.
Figure 21:
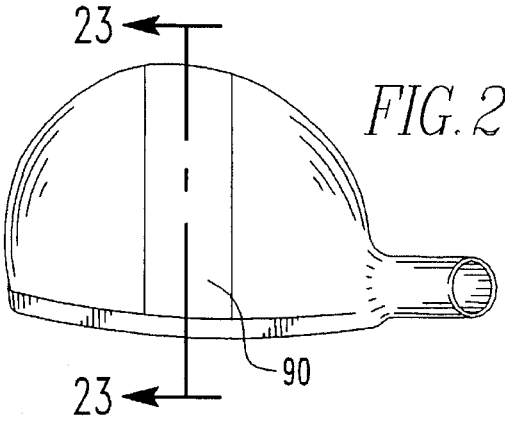
FIG. 21 is a top view of the golf club head of FIG. 20.
Figure 22:
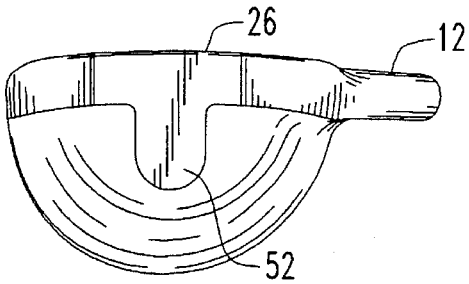
FIG. 22 is a bottom view of the golf club head of FIG. 20.
Figure 23:
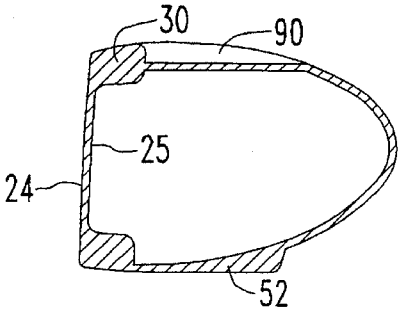
FIG. 23 is a section view of the golf club head of FIG. 20, taken along line 23—23 of FIG. 20.

FIGS. 18–19 illustrate another embodiment of the present invention which is similar to the club head illustrated in FIGS. 14–15, except for the addition of a ground engaging or ski sole member 52 extending from the bottom of the frontal body section 60. This sole may be formed in the bottom surface of the shell 70, or alternately can be included as an extension of the frontal body section 60 and the bottom peripheral mass 30. As shown in FIG. 19, the hosel 12 of the club head transitions into and extends into the peripheral mass 30 positioned at the heel, top and bottom surfaces of the club head. In this embodiment, the peripheral mass extends completely around the periphery of the frontal body section of the club head.

FIGS. 20–23 illustrate another embodiment of the invention which is analogous in the construction to that shown in FIGS. 14–15, with the exception that in this embodiment the ball striking face 24 has a bulge and roll. The club head also includes both a sole skimmer or ground engaging member 52 and one or more aerodynamic channels 90 formed at the top of the club head, which can be of a variety of forms like those disclosed in U.S. Pat. Nos. 5,221,086; 4,930,783; and 4,828,265, which are hereby incorporated by reference. In this embodiment, the sole skinner 52 is formed as an extension of the frontal body section 60, including the bottom portion of the peripheral mass 30. This design provides excellent structural integrity, as well as added mass directly behind and below the clubhead's center of gravity. The design also permits the use of a smaller shell 70, since the skimmer rather than the shell engages the ground during address and hitting. In this embodiment, the aerodynamic channel 90 is formed completely in the shell, although the channel could be extended to the ball striking face of the club, if desired, by forming a channel in the central part of the upper portion of the peripheral mass 30 and the ball striking face.

Figure 24:
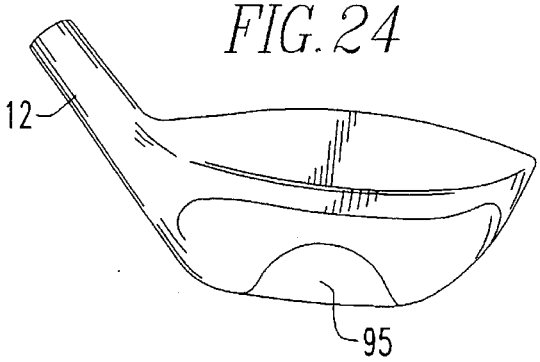
FIG. 24 is a rear view of an eleventh embodiment of a golf club head of the present invention.

FIG. 24 illustrates an embodiment of the invention which is similar in configuration to that shown in any of the club heads of the previous embodiments, with the exception that an opening 95 is included in the rear of the club head. The opening preferably is circular or oval in configuration with a diameter of approximately one inch. The inclusion of such an opening provides a pressure release that promotes full flexing of the ball striking face, as previously disclosed. The inclusion of this opening also allows the redistribution of weight for optimum performance.

Figure 25:
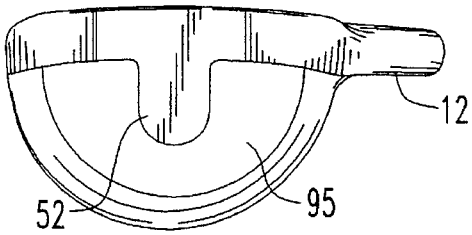
FIG. 25 is a bottom view of a twelfth embodiment of a golf club head of the present invention.

FIG. 25 illustrates an embodiment, like that shown in FIGS. 19–22, except that it has a wider opening 95 formed in the bottom of the shell. A similar shell with an opening in the bottom of the clubhead can be incorporated in other embodiments and designs of the present inventions.

Figure 26:
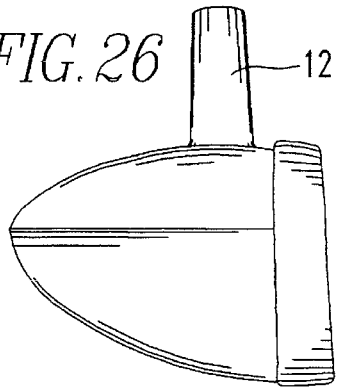
FIG. 26 is a side view of a thirteenth embodiment of a golf club head of the present invention.

Another embodiment of the club head of the present invention is shown in FIG. 26. That embodiment illustrates an embodiment in which the hosel 12 is spaced further back from the ball striking face 24 and interconnects directly with the shell. Preferably, the hosel 12 extends well within the shell, for example, in the manner shown in FIG. 5. As an alternative, the hosel 12 can both extend within the shell and transition at the inside of the club head with the peripheral mass 30.

Figure 27:
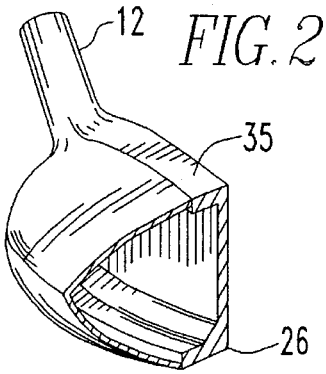
FIG. 27 is a partial perspective view of a fourteenth embodiment of a golf club head of the present invention.

FIG. 27 is a partial perspective view of another embodiment of the club head of the present invention. As shown, the peripheral mass in that club head is rectangular in cross section at the top of the club head and is somewhat triangular in cross section at the bottom. The peripheral mass provides an extended ledge 35 along the top surface of the frontal body section and has a front to rear thickness of approximately 0.250 to 0.400 inches at the top and 0.250 to 0.500 inches at the bottom. The peripheral mass at the bottom of the club head has a rearward ledge and is more massive in its entirely than the peripheral mass that extends along the top.

Figure 28:
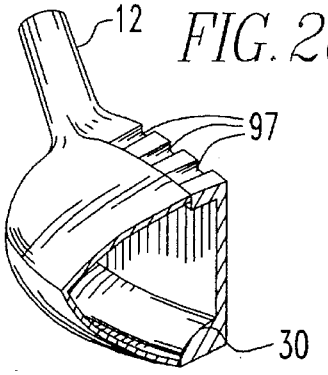
FIG. 28 is a partial perspective view of a fifteenth embodiment of a golf club head of the present invention.

The embodiment illustrated in FIG. 28 is similar in configuration to that shown in FIG. 27, with the exception that the peripheral mass include aerodynamic slots 97 formed in its top surface and has a more rounded cross section along its bottom portion.

Figure 29:
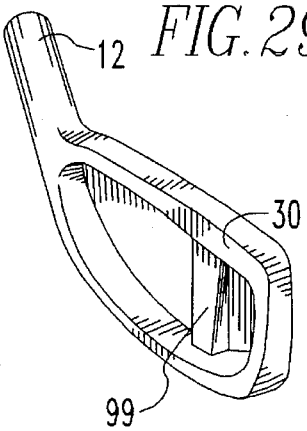
FIG. 29 is a partial rear perspective of a sixteenth embodiment of a golf club head of the present invention.

In the embodiment of the invention illustrated in FIG. 29, the peripheral mass 30 extends completely along the interface of the striking face with the crown, side walls, and bottom of the club head. This embodiment includes an additional weight element 99 to provide improved performance and a stronger bracing structure. In this embodiment, the weight element takes the form of a substantially vertical, wedge-shaped element which is positioned at the toe side of the club head's center of gravity and which becomes progressively thicker in the front to rear direction as it proceeds from top to bottom. This design provides added mass to the point where ball contact most frequently occurs.

Figure 30:
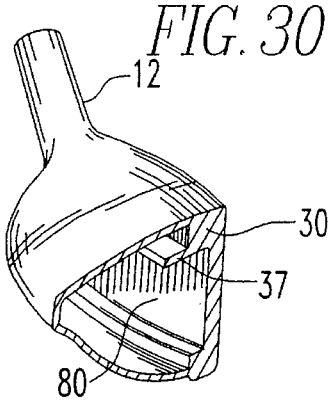
FIG. 30 is a partial perspective of a seventeenth embodiment of a golf club head of the present invention.

In the embodiment illustrated in FIG. 30, the peripheral mass has an extending ledge 37 which extends inwardly into the cavity 80 formed between the rear shell and the front body section. This ledge 37 adds more weight at the top half of the club head, produces firmer flexing of the striking face, and also distributes that weight closer to the clubhead's center of gravity. The ledge preferably extends from the heel to the toe of the club head.

Figure 31:
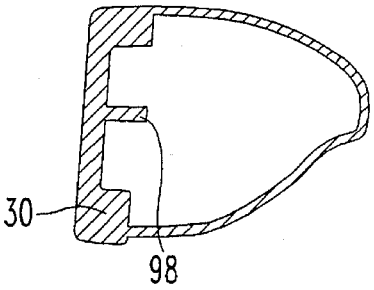
FIG. 31 is a sectional view of an eighteenth embodiment of a golf club head of the present invention.

In the embodiment illustrated in FIG. 31, the peripheral mass 30 extends along at least the top and bottom of the club head and in addition includes a brace member 98 which extends from the heel to toe and runs approximately through the club head's center of gravity. This design provides enhanced stability and strength to the club head, as well as a beneficial weight distribution.

Figure 32:
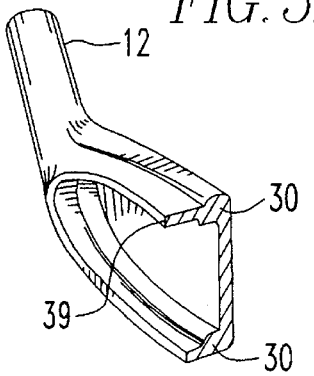
FIG. 32 is a partial perspective view of a nineteenth embodiment of a golf club head of the present invention.

FIG. 32 is a partial perspective view of another embodiment of the golf club head of the present invention. In this embodiment, the rearward portion of the peripheral mass 30 is thinner than the front portion and provides an extended ledge 39. The use of this ledge permits the lowering of the shell and the placement of the rear of the club head closer to the club head's center of gravity. In this clubhead, the top portion of the peripheral mass is heavier than the bottom portion of the peripheral mass.

Figure 33:
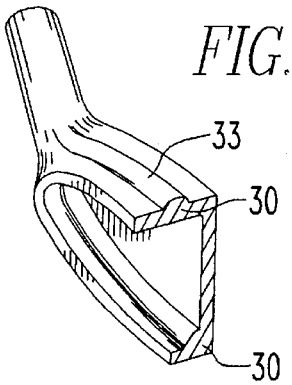
FIG. 33 is a partial perspective view of a twentieth embodiment of a golf club head of the present invention.

FIG. 33 is a partial perspective view of another embodiment of the present invention. As illustrated, the top portion of the peripheral mass 30 includes a elongated raised portion 33 which runs from the hosel 12 to the toe 18 of the club head and adds strength and stability to the clubhead. Again, in this embodiment, the top portion of the peripheral mass is heavier than the bottom of that mass.

Figure 34:
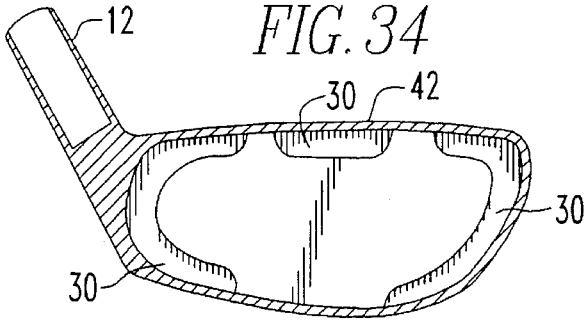
FIG. 34 is a rear section of a twenty-first embodiment of a golf club head of the present invention.

In the embodiment illustrated in FIG. 34, the peripheral mass 30 is segmented and formed of three separate portions. The portions formed at the toe and heel respectively, extend into the top and bottom portions of the frontal body section 60 and provide excellent weight distribution as well as strength. These sections are spaced approximately 0.250 inch from the top central peripheral mass portion.

Figure 35:
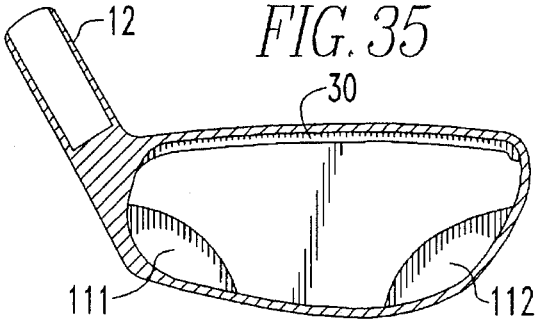
FIG. 35 is a rear section of the twenty-second embodiment of a golf club head of the present invention.

In the embodiment illustrated in FIG. 35, the club head includes a peripheral mass 30 which extends along the upper periphery of the frontal body section 60, similar to that shown in earlier embodiments. However, in this embodiment, the club head also includes additional weight members 111 and 112 formed at the bottom heel and toe of the club head, thereby providing a preferred form of weight distribution.

Figure 36:
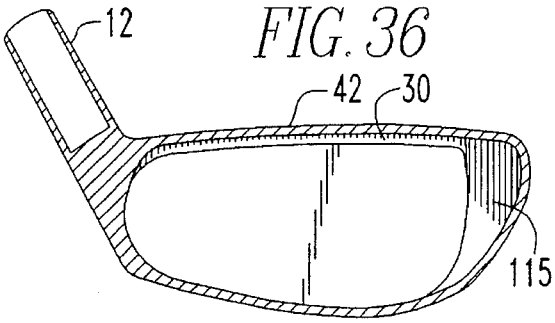
FIG. 36 is a rear section of an twenty-third embodiment of a golf club head of the present invention.

Similarly, FIG. 36 illustrates an embodiment which has a peripheral mass extending along the upper periphery of the frontal body section 60 and includes an additional weight member 115 formed at the toe of the club head and extending generally in a vertical direction.

Figure 37:
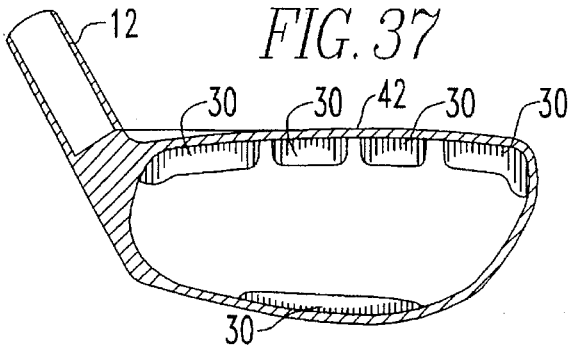
FIG. 37 is a rear section of a twenty-fourth embodiment of a golf club head of the present invention.

FIG. 37 illustrates another embodiment of the club head and illustrates a segmented peripheral mass 30 which extends along the upper portion of the frontal body section and also transitions partially into the heel and toe portions of the frontal body section. The peripheral mass 30 also includes a portion at the interface of the ball striking face and the bottom of the club head. Preferably, the upper segments are spaced from each other by no more than a quarter of an inch.

It will be further appreciated that a variety of shell configurations may be provided for various functional and aerodynamic effects. Furthermore, the rear club face of the frontal body section may be reinforced with a variety of weighting arrangements to enhance the performance of the club head. Other modifications include placement of the hosel in a variety of positions across the top portion of the club head.

It will become apparent to those skilled in the art that various modifications and variations may be made to the golf club head of the present invention and in construction of this club head without departing from the spirit and scope of the invention as defined in the following claims.

I claim:

1. A metal wood-type golf club head comprising:

a golf club head body including a heel, toe, bottom, crown, side walls, ball striking face and a rear club face, said ball striking face intersecting with a forward most progression of said bottom to define a leading edge of the ball striking face;

a hosel integrally connected to said club head body; and a peripheral mass positioned along at least the majority of the interface of the ball striking face and the crown of the club head, wherein the hosel extends into and connects with a portion of said peripheral mass, thereby providing added strength and stability to the club head and minimizing pinging of the club head when ball contact is made.

2. The golf club head of claim 1 wherein said peripheral mass extends along the entire interface of the ball striking face and the crown of the club head.

3. The golf club head of claim 1 wherein said peripheral mass extends downward along at least the upper portions of the respective interface between the ball striking face and the side walls, adjacent the heel and toe of the club head.

4. The golf club head of claim 1 wherein said peripheral mass also extends along at least a portion of the interface of the ball striking face and the bottom of the club head.

5. The golf club head of claim 1 wherein said peripheral mass extends around substantially the entire interface between the ball striking face and the crown, side walls, and bottom of the club head.

6. The golf club head of claim 1 wherein said peripheral mass includes a plurality of separate segments.

7. The golf club head of claim 1 wherein said hosel has a front surface and rear surface and wherein the rear surface smoothly transitions into the said peripheral mass providing additional structural integrity and strength at the heel portion of the club head and the front surface is positioned behind the ball striking face of said club head body forming a shankless connection between said hosel and said club head body.

8. The golf club head of claim 1 wherein said peripheral mass is thicker than the walls of the ball striking face immediately adjacent said peripheral mass and is thicker than the wall of the crown immediately adjacent said peripheral mass.

9. The golf club head of claim 1 further comprising a plurality of substantially vertical bars extending from said peripheral mass downwardly along the rear club face of the club head.

10. The golf club head of claim 1 further comprising a strut extending along the underside of said crown in a heel to toe direction.

11. The golf club head of claim 1 wherein said hosel extends into the club head body and is fixed to at least the inner walls of the heel of the club head.

12. The golf club head of claim 1 wherein said peripheral mass includes a bottom peripheral mass that extends along at least the portion of the interface of the ball striking face and the bottom of the club head proximate the heel of the club head and wherein said hosel has a front surface and a rear surface, the rear surface of said hosel smoothly transitioning into the most rearward portion of said bottom peripheral mass proximate the heel of the club head.

13. A metal wood-type golf club head comprising:

a golf club head body including a heel, toe, bottom, crown, ball striking face and rear club face, said ball striking face intersecting with a forwardmost progression of said bottom to define a leading edge of the ball striking face;

said club head body having a frontal body section and a rearward shell attached to said frontal body section at the interface of said frontal body section and said rear shell;

a hosel integrally connected to said club head body;

said frontal body section including:

the ball striking face;

the rear club face; and a peripheral mass projecting outwardly from the rear club face and extending around at least a portion of the outer periphery of said frontal body section, thereby providing added strength and stability to the club head and minimizing pinging of the club head when ball contact is made; and said shell extending rearwardly beyond said frontal body section and forming the crown, the rear portion of said club head, and a cavity behind said frontal body section.

14. The golf club head of claim 13 further comprising a sole plate attached to said frontal body section and said rear shell.

15. The golf club head of claim 13 wherein said peripheral mass extends along at least the majority of the top outer periphery of said frontal body section.

16. The golf club head of claim 15 wherein said peripheral mass extends adjacent the heel of the club head around the outer periphery of said frontal body section.

17. The golf club head of claim 16 wherein said hosel is integrally connected to said frontal body section of said club head and extends into and connects with at least a portion of said peripheral mass.

18. The golf club head of claim 13 wherein said peripheral mass extends along both the top and the bottom of the outer periphery of said frontal body section.

19. The golf club head of claim 18 wherein said hosel is integrally connected to said frontal body section and extends into and connects with said peripheral mass at both the top and the bottom of said frontal body section.

20. The golf club head of claim 13 wherein said peripheral mass extends at least along the entire top outer periphery of said frontal body section.

21. The golf club head of claim 13 wherein said peripheral mass includes a plurality of separate segments.

22. The golf club head of claim 13 wherein peripheral mass extends around substantially the entire outer periphery of said frontal body section.

23. The golf club head of claim 13 wherein at the interface of said frontal body section and said rear shell, said upper crown surface is recessed below the uppermost portion of said frontal body section, thereby forming a ledge that extends from a heel to toe direction.

24. The golf club head of claim 13 wherein at the interface of said forward body section and said rear shell, the bottom of said shell is recessed above the lowermost portion of said forward body section, thereby forming a ledge in a heel to toe direction, and further comprising a sole skimmer extending from the leading edge toward the rear surface of the club head and projecting outwardly from the portion of said rear shell proximate said sole skimmer.

25. The golf club of claim 24 wherein said sole skimmer extends into and is connected with said peripheral mass at the bottom periphery of said frontal body section.

26. The golf club of claim 25 wherein said sole skimmer has a length in a front to rear direction of at least 0.500 inches and a width in a toe to heel direction of at least 0.500 inches.

27. The golf club head of claim 13 further comprising at least one secondary weight member extending outwardly from the rear club face of said frontal body section.

28. The golf club head of claim 27 wherein said secondary weight member is a bar extending in a top to bottom direction.

29. The golf club head of claim 27 wherein there are two secondary weight members, one being positioned proximate the heel of the club head and the second being positioned proximate the toe of the club head.

30. The golf club head of claim 13 wherein said peripheral mass extends at least along the top periphery of said frontal body section and wherein a plurality of outer slots are formed in the top outer surface of said peripheral mass.

31. The golf club head of claim 13 wherein said integral connection between said hosel and club head body is in a shankless configuration.

32. The golf club head of claim 13 further including a sole skimmer extending outwardly from the bottom of said club head in a front to rear direction.

33. The golf club head of claim 13 wherein said shell section includes an opening formed in the bottom thereof and extending into the cavity of said golf club head.

34. The golf club head of claim 13 wherein said shell includes an opening formed in the rear thereof and extending into the cavity of said golf club head.

35. The golf club head of claim 13 wherein said peripheral mass includes a first main body portion and an inner ledge portion spaced below the crown of the club head and extending rearwardly from said first main body portion.

36. The golf club head of claim 13 wherein said frontal body section is made from a first material and the rear shell is made from a second material.

37. The golf club head of claim 36 wherein said second material is lighter in relative weight than the first material.

38. The golf club head of claim 13 wherein said peripheral mass extends along the interface of the crown and the ball striking face of the club head and downwardly along at least a portion of the respective interfaces between the ball striking face and the side walls, adjacent the heel and toe of the club head.

39. The golf club head of claim 13 further comprising a brace extending rearwardly from the rear club face of the club head in a heel to toe direction.

40. The golf club head of claim 1 further including a sole skimmer extending outwardly from the bottom of the club head in a front to rear direction.

41. The golf club of claim 5 further including a sole skimmer extending outwardly from the bottom of the club head in a rear to front direction.

42. The golf club head of claim 41 wherein the sole skimmer extends into and is connected with the peripheral mass at the bottom of the club head.

43. The golf club head of claim 1 further comprising at least one secondary weight member extending outwardly from the rear club face of the golf club head body.

44. The golf club head of claim 43 wherein the secondary weight member is a bar extending in a top to bottom direction.

45. The golf club head of claim 43 wherein there are two secondary weight members, each in the form of a bar extending in a top to bottom direction, one being positioned proximate the heel of the club head and the second being positioned proximate the toe of the club head.

46. The golf club head of claim 45 wherein the secondary weight members extend into and connect with the peripheral mass.

47. The golf club head of claim 1 wherein the golf club head body includes an opening formed in the bottom thereof.

48. The golf club head of claim 1 wherein the golf club body includes an opening formed in the rear thereof.

49. The golf club head of claim 1 wherein the peripheral mass has a front to rear thickness of at least 0.125 inches and has a top to bottom thickness of at least 0.125 inches.

50. The golf club head of claim 1 wherein said peripheral mass also extends along at least the majority of the interface of the ball striking face and the sole of the club head.

51. The golf club head of claim 50 wherein the peripheral mass at the bottom of the club head is more massive than the peripheral mass at the top of the club head.

52. The golf club head of claim 50 wherein the peripheral mass at the top of the club head is more massive than the peripheral mass at the bottom of said club head.

53. The golf club head of claim 1 further comprising a plurality of aerodynamic slots formed in its top surface and extending in a front to rear direction.

54. The golf club head of claim 1 wherein said peripheral mass includes a ledge which extends rearwardly from said peripheral mass, the ledge being spaced below the crown.

55. The golf club head of claim 1 further comprising a strut formed on and extending along the underside of said crown in a heel to toe direction.

56. A metal wood-type golf club head consisting essentially of:

a golf club head body made only from a metal material, said golf club head body including a heel, toe, bottom, crown, side walls, ball striking face and a rear club face, said ball striking face intersecting with a forward most progression of said bottom to define a leading edge of the ball striking face;

said ball striking face having a thickness in a front to rear direction of at least 0.100 inch;

a hosel integrally connected to said club head body; and a peripheral mass positioned along at least the majority of the interface of the ball striking face and the crown of the club head, said peripheral mass having a thickness in a front to rear direction of at least 0.125 inches, thereby providing added strength and stability to the club head and minimizing pinging of the club head when ball contact is made.

57. The golf club head of claim 56 wherein said peripheral mass extends downward along at least the upper portions of the respective interface between the ball striking face and the side walls, adjacent the heel and toe of the club head.

58. The golf club head of claim 56 wherein said peripheral mass extends around substantially the entire interface between the ball striking face and the crown, side walls, and bottom of the club head.

59. The golf club head of claim 56 further comprising a plurality of substantially vertical bars extending from said peripheral mass downwardly along the rear club face of the club head.

* * * * *